US007816593B2

(12) United States Patent
Heiserman

(10) Patent No.: US 7,816,593 B2
(45) Date of Patent: Oct. 19, 2010

(54) MUSICAL INSTRUMENT SOUND MAXIMIZER

(76) Inventor: Scott Heiserman, 2627 Schuller Ct., Chaska, MN (US) 55318-1171

( * ) Notice: Subject to any disclaimer, the term of this patent is extended or adjusted under 35 U.S.C. 154(b) by 197 days.

(21) Appl. No.: 12/099,115

(22) Filed: Apr. 7, 2008

(65) Prior Publication Data

US 2008/0276786 A1 Nov. 13, 2008

Related U.S. Application Data

(60) Provisional application No. 60/922,150, filed on Apr. 7, 2007.

(51) Int. Cl.
*G10D 3/10* (2006.01)

(52) U.S. Cl. ..... 84/297 S; 702/182

(58) Field of Classification Search ..... 84/297 S; 702/182

See application file for complete search history.

(56) References Cited

U.S. PATENT DOCUMENTS

| | | | |
|---|---|---|---|
| 3,881,389 | A | 5/1975 | Allen et al. |
| 4,061,071 | A | 12/1977 | Cameron et al. |
| 4,539,228 | A | 9/1985 | Lazarus et al. |
| 5,365,164 | A | 11/1994 | Lowenstein et al. |
| 5,767,429 | A | 6/1998 | Milano et al. |
| 5,801,319 | A | 9/1998 | Hebestreit et al. |
| 5,977,467 | A | 11/1999 | Freeland et al. |
| 6,580,021 | B2 | 6/2003 | Barney et al. |

FOREIGN PATENT DOCUMENTS

EP 1731893 A1 * 12/2006

* cited by examiner

*Primary Examiner*—Jianchun Qin
(74) *Attorney, Agent, or Firm*—McCarthy Law Group

(57) ABSTRACT

Embodiments of the present invention are directed to deriving a useful life value of a vibrating member in a musical instrument by analyzing a spectral response to sound produced by the vibrating member.

20 Claims, 3 Drawing Sheets

MUSICAL INSTRUMENT SOUND MAXIMIZER

CROSS-REFERENCE TO RELATED APPLICATIONS

This application claims benefit to the filing date of provisional application No. 60/922,150.

BACKGROUND

A good number of musical instruments use a vibrating member to produce melodic sound. A guitar, for example, relies on performance of the mechanical motion of a number of taut strings to make music. A new string exhibits a sound that is referred to as being "rich" or "bright" in comparison to a well-worn string. A number of ordinary factors come into play that cause normal wear and tear on the strings, such as the amount of play time, hand cleanliness, hand natural oil and pH content, string construction and quality, environmental conditions like humidity and temperature, and the like.

Thus, strings not only wear at different rates for different players, but each set of strings likewise wears at a different rate for the same player. Eventually, the strings wear to a point where they go flat, and although they are still tunable, their useful life is expended because they have lost the desired richness of sound. However, the wear occurs so gradually that soon after replacing a set of strings the player will tend to continuously be on guard as to whether they need to be changed again. Changing the strings too early is wasteful of time and resources, but changing them too late exposes the player to not putting her best foot forward musically. This same problem exists for other types of musical instruments as well that use a vibrating member to produce melodic sounds.

What is needed is a way for the player to quantitatively ascertain what the useful life of the vibrating member is, so that she can better attend to making music by not intuitively servicing her instrument. It is to improvements in the art directed to that need that the present embodiments are directed.

SUMMARY

Embodiments of the present invention are directed to deriving a useful life value of a vibrating member in a musical instrument by analyzing a spectral response to sound produced by the vibrating member.

In some embodiments an apparatus is provided having an input that is capable of receiving the sound from the vibrating member and transmitting a signal that is characteristically representative of the sound. A sound maximizer circuit is coupled to the input that quantitatively characterizes the useful life value based on analyzing the harmonic content of a predetermined upper spectrum of the signal and comparing it against predefined or user-defined wear threshold levels.

In some embodiments an apparatus is provided having an input that is capable of receiving the sound from the vibrating member and transmitting a signal that is characteristically representative of the sound. A high pass filter receives the signal and outputs the harmonic content of a predetermined upper spectrum of the signal. A controller quantitatively derives the useful live value of the vibrating member based on the output of the high pass filter. Because the amplitude output of the high pass filter is evaluated by the controller, certain provisions must be given relative to the amplitude level of the original sound signal. A relatively high or low original sound signal requires proportional level or computational adjustment to the high pass filter signal.

DETAILED DESCRIPTION

Figure 1:
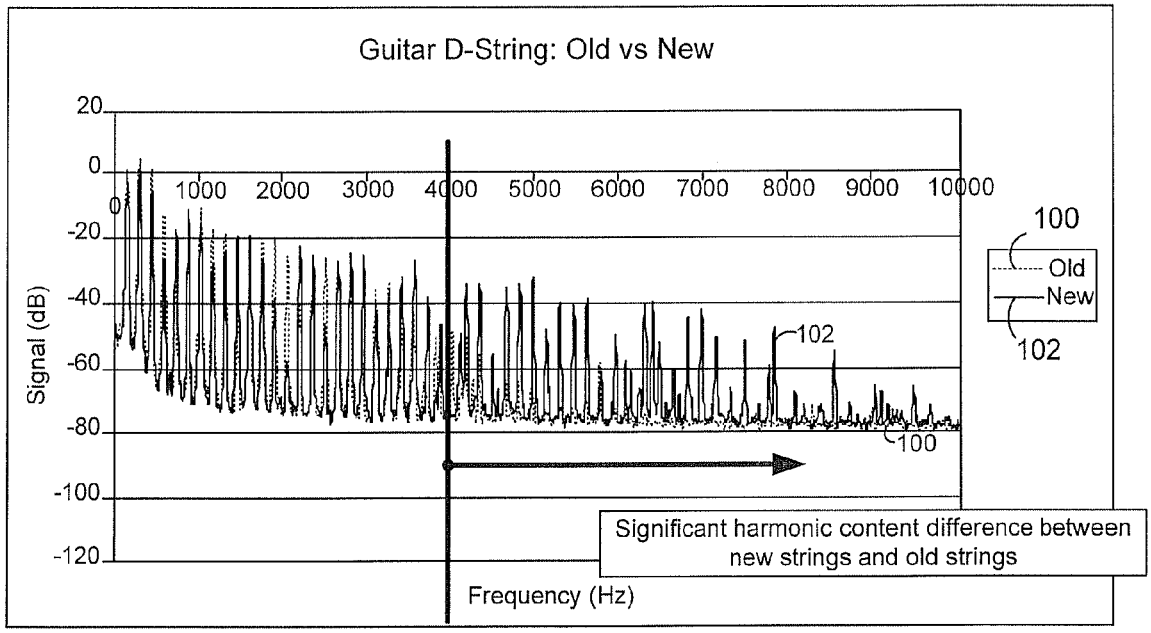
FIG. 1 is a graphical representation of spectral analyses for both a new and an old guitar string, depicting how the upper harmonic content of sound produced by a guitar string diminishes over time.
Figure 2:
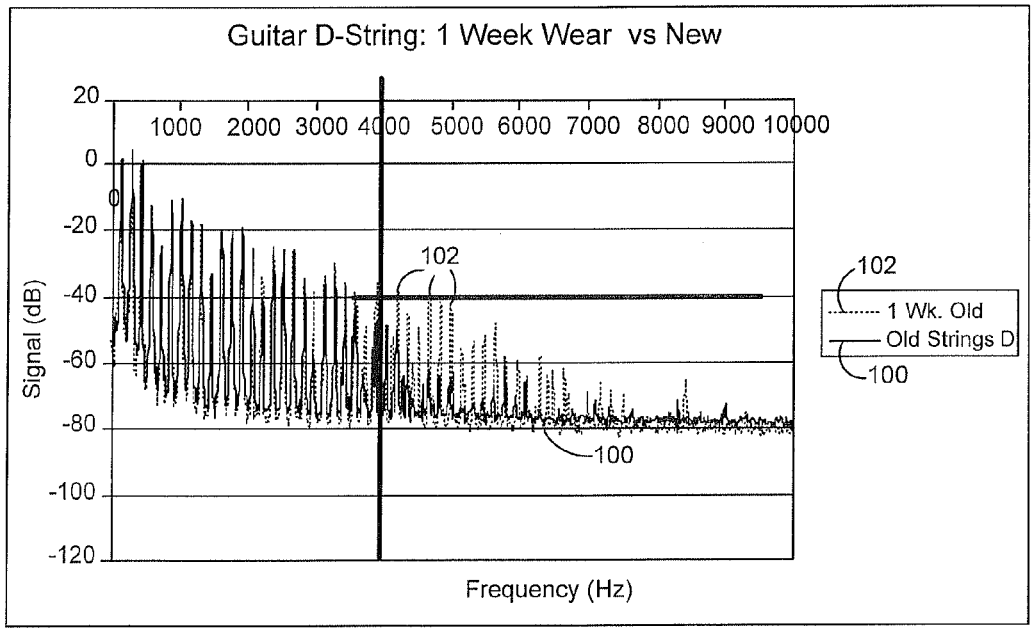
FIG. 2 is a graphical representation similar to FIG. 1 after the "new" guitar string is one week old and has been subjected to normal usage.
Figure 3:
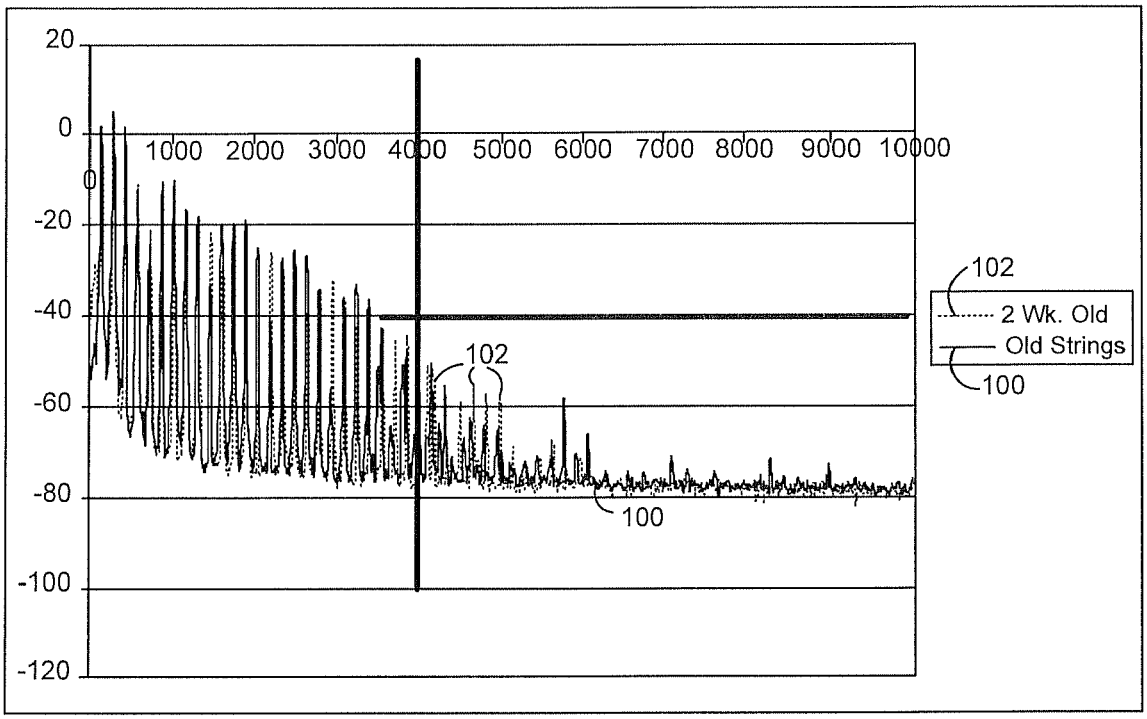
FIG. 3 is a graphical representation similar to FIG. 1 after the "new" guitar string is two weeks old and has been subjected to normal usage.

FIG. 1 graphically depicts test data comparing the spectral responses 100, 102 of the sounds made by two characteristically different D-strings when mounted on the same guitar. The response 100 is that of a comparatively old string that has been used so long it is musically flat. The response 102 is that of a brand new string. It is observed that below a certain threshold frequency, in this case at about 4 KHz, the lower spectrum harmonic contents of the strings are similar. However, the upper spectrum harmonic content, above the threshold frequency, is measurably different. Note that the other guitar strings demonstrated the same characteristics, albeit they have different threshold frequencies differentiating the lower and upper spectrums. FIGS. 2 and 3 are elapsed time responses 100, 102 of the strings obtained after one week and after two weeks, respectively, depicting the gradual nature with which the upper spectrum harmonic content diminishes.

The present embodiments contemplate a portable apparatus small enough to fit with the guitar in its case, along with an associated method that leverages this measurable diminishment of the upper harmonic content to quantify a useful life value of the strings. Preferably, the apparatus is constructed of miniaturized solid state electronics including a processor-based controller, or comparable control apparatus, to provide a hand-held and battery powered device comparable in size and weight to electronic digital tuners that are commercially available. The term "useful life" is associated with whether a predetermined amount of wear has occurred that causes desire in the player to change the strings because they have lost their ability to make rich sounds in accordance with the players desired level of string performance at a given time. Note that a string's useful life is shorter than a time during which the string is still playable and tunable.

Figure 4:
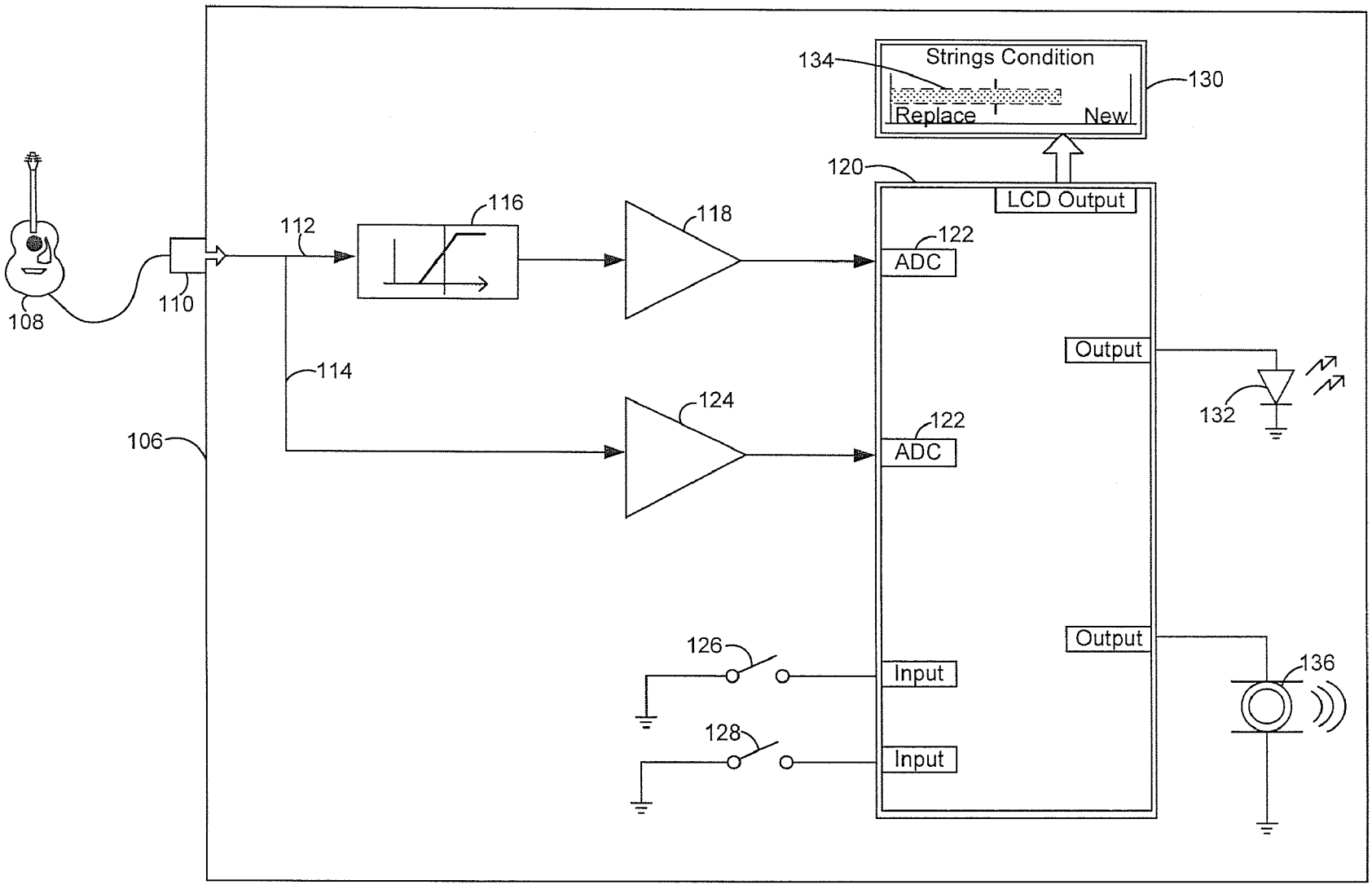
FIG. 4 is a diagrammatic functional depiction of a musical instrument sound maximizer apparatus that is constructed in accordance with illustrative embodiments of the present invention.

FIG. 4 diagrammatically depicts a functional representation of a musical instrument sound maximizer apparatus ("apparatus") 106 that is constructed in accordance with some illustrative embodiments of the present invention. A guitar 108 is depicted as being audibly connected to the apparatus 106 via an electrical conductor plugged into an audio jack 110 that is provided as input to the apparatus 106. The use of the apparatus 106 to measure the useful life of guitar strings is merely illustrative and not limiting of all possible uses. The apparatus 106 is useful for determining the useful live of other vibrating members that produce sound in musical instruments as well, such as a reed in a woodwind instrument.

Connecting the instrument by a direct line is merely illustrative as well, because some instruments are not equipped with an audio output jack. In alternative equivalent embodiments that are not depicted, an internal microphone can be integral to the apparatus 106 or an external microphone can be plugged into the audio jack 110 and positioned to pick up the sound from the instrument. "Microphone" for purposes of this description generally includes all vibration-to-signal converting devices, including common microphones as well as piezoelectric devices and the like.

Preferably, a virtual ground circuit is incorporated into the apparatus 106 for optimal alternating current ("AC") amplification and buffering of the signal in the apparatus 106 that is created in response to the sound produced by plucking a guitar string. That analog signal is transmitted via two paths 112, 114.

The analog signal in path 112 is conditioned by a high pass filter 116 to attenuate the lower harmonic content below the predetermined threshold frequency, passing only the upper harmonic content. The upper harmonic content signal output from the high pass filter 116 is boosted by a gain $K_1$ via amplifier 118 and then input to a microprocessor 120 with integral analog-to-digital converter 122. The analog signal in path 114 is boosted by a gain $K_2$ via amplifier and low pass filter 124 that attenuates some or all of the upper harmonic content of the signal, and then is likewise input to the microprocessor 120 with integral analog-to-digital converter 122.

Figure 5:
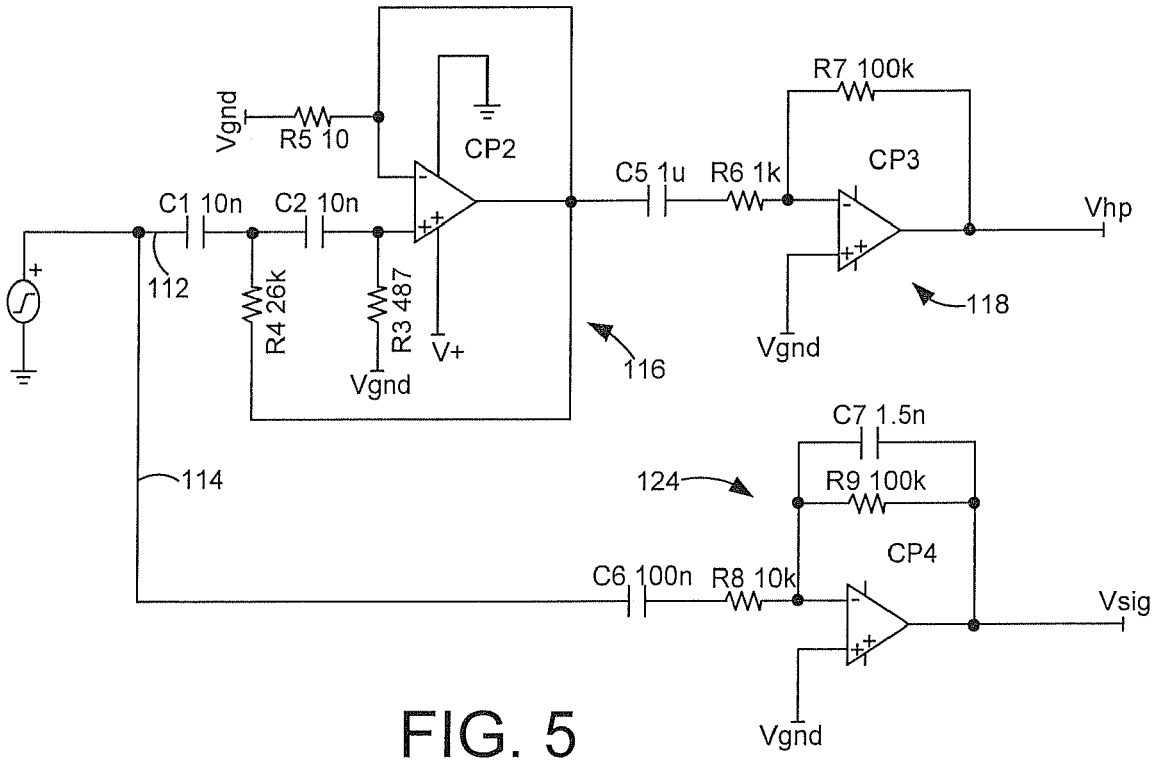
FIG. 5 is a schematic depiction of parts of the analog circuitry in the musical instrument sound maximizer apparatus of FIG. 4 in accordance with illustrative embodiments of the present invention.

FIG. 5 schematically depicts illustrative embodiments of parts of the analog circuitry of the apparatus 106 described above. For example, and not by way of limitation, the claimed embodiments have been successfully reduced to practice by constructing the high pass filter 116 of a two-pole Sallen-Key configuration, with the three decibel ("dB") point at 4 KHz and with roll-off of 40 dB per decade. The input analog signal transmitted via path 112 is filtered and amplified to provide a signal that is indicative of the upper harmonic value, $V_{hp}$. The same input analog signal transmitted via path 114 is filtered, such as by the one-pole low pass filter depicted, and amplified to provide a signal that is indicative of the lower harmonic value, $V_{sig}$.

Returning to FIG. 4, the apparatus 106 includes a number of switches 126, 128 serving as a human interface for operating the apparatus. It will be noted that the number and functionality of switches depicted and described herein is merely illustrative and not limiting of the contemplated embodiments. Switch 126 is toggled to begin the signal acquisition process. Preferably, the apparatus 106 will select a string to be tested based on frequency content as the musical instrument is being played or tuned. The condition of a single string can be used to infer the condition of all strings, since the strings are typically changed out as a set. After toggling switch 126 to request the apparatus 106 to assess string condition, the apparatus 106 then initializes itself to receive the sound and prompts the user to pluck the selected string or group of strings. The apparatus 106 will also support an automatic mode of operation, so that the condition of the strings is displayed periodically, without intervention from the user. Toggling switch 126 allows the user to place the apparatus in automatic mode.

When the apparatus 106 detects the sound of the plucked string, it initiates a timer and digitally records both $V_{hp}$ and $V_{sig}$ during a predetermined interval. The apparatus 106 can provide a visible indication that a test signal has been successfully captured by pulsing a light emitting diode ("LED") 132. Data for both signals are averaged for peak-to-peak values, and those amplitude values are then divided in the ratio $V_{hp}/V_{sig}$. This ratio quantitatively compares the amount of upper harmonic content with respect to the lower harmonic content; that is, a higher ratio indicates relatively better harmonics-rich sound from a string with relatively more useful life. The ratio is scaled, adjusted for predetermined threshold levels, and then displayed on LCD 130 to report a quantitative useful life value 134. The display of the useful life value 134 can be accompanied by an audible indication of a completed measurement by energizing a speaker 136. FIG. 4 depicts the useful life value 134 being reported in the form of a bar graph. Switch 128 can be toggled to change the display between the graphical depiction and a numerical depiction of the useful life value, such as the latter representing the ratio as a value within a range of "0" to "100."

Again, the embodiments depicted in the FIGS. are merely illustrative and not limiting of all constructions within the contemplated embodiments. The skilled artisan readily recognizes that the very nature of miniaturized integrated circuitry makes it possible to achieve a measurement in various different ways. For example, in equivalent alternative embodiments the apparatus 106 could normalize the incoming analog signal such as with an automatic gain control ("AGC") circuit relative to a predetermined baseline dB level. That would permit basing the useful life value 134 directly on measuring the upper harmonic content, in a manner like that described above, rather than upon the ratio of the upper to lower harmonic contents. Another example is the use of a digital signal processor (DSP) in alternative equivalent embodiments of the apparatus 106. The DSP could, through software methods, perform high pass, low pass and other filter functions in software, as well as performing all the input, output and display requirements described above.

It is to be understood that even though numerous characteristics and advantages of various embodiments of the present invention have been set forth in the foregoing description, together with details of the structure and function of various embodiments of the invention, this detailed description is illustrative only, and changes may be made in detail, especially in matters of structure and arrangements of parts within the principles of the present invention to the full extent indicated by the broad general meaning of the terms in which the appended claims express. For example, the particular elements may vary in type or arrangement without departing from the spirit and scope of the present invention.

In addition, although the embodiments described herein are directed to illustrative embodiments describing the processing of musical sounds, it will be appreciated by those skilled in the art that the claimed subject matter is not so limited and various other systems can utilize the present embodiments without departing from the spirit and scope of the claimed invention.

What is claimed:

1. An apparatus that derives a remaining useful life value of an operably vibrating component in a musical instrument, the apparatus comprising:

a portable enclosure;

an audio input in the portable enclosure that is externally connectable to the musical instrument to receive a musical sound made by the vibrating member and in turn to transmit a signal that is characteristically representative of the musical sound;

a signal converter in the portable enclosure coupled to the audio input that transmits a harmonic content of a predetermined spectrum of the signal; and a processor in the portable enclosure coupled to the signal converter that analyzes the harmonic content to derive the remaining useful life value of the vibrating member.

2. The apparatus of claim 1 wherein the processor averages peak to peak amplitudes of the signal in the predetermined spectrum to derive a first signal value for the signal.

3. The apparatus of claim 2 wherein the processor averages peak to peak amplitudes of the signal in another spectrum not in the predetermined spectrum to derive a second signal value for the signal.

4. The apparatus of claim 3 wherein the another spectrum is a predetermined lower spectrum of the signal.

5. The apparatus of claim 3 wherein the processor derives the remaining useful life value in terms of a ratio of the first signal value to the second signal value.

6. The apparatus of claim 1 comprising a visual indicator that quantifies the remaining useful life value.

7. The apparatus of claim 6 wherein the visual indicator comprises a numeric display.

8. The apparatus of claim 6 wherein the visual indicator comprises a graphical display.

9. The apparatus of claim 1 comprising a recorder that digitally records the musical sound from the audio input.

10. The apparatus of claim 9 wherein the recorder digitally records the musical sound from the audio input for a predetermined interval of time.

11. The apparatus of claim 9 comprising a visual indicator that signals when the recorder has digitally recorded the musical sound from the audio input.

12. The apparatus of claim 1 wherein the audio input comprises an electrical connector in the enclosure.

13. The apparatus of claim 1 wherein the audio input comprises a microphone in the enclosure.

14. An apparatus that derives a remaining useful life value of an operably vibrating component in a musical instrument, the apparatus comprising:

a portable enclosure;

an audio input in the portable enclosure that is externally connectable to the musical instrument to receive a musical sound made by the vibrating member and in turn to transmit a signal that is characteristically representative of the musical sound;

a high pass filter in the portable enclosure that receives the signal and in turn outputs a harmonic content of a predetermined upper spectrum of the signal; and a controller that quantitatively derives the remaining useful live value of the vibrating member based on the output of the high pass filter.

15. The apparatus of claim 2 wherein the controller comprises a signal processor circuitry that averages peak to peak amplitudes of the signal in the predetermined spectrum to derive a first signal value for the signal.

16. The apparatus of claim 15 wherein the signal processor circuitry averages peak to peak amplitudes of the signal in another spectrum not in the predetermined spectrum to derive a second signal value for the signal.

17. The apparatus of claim 16 wherein the signal processor circuitry derives the remaining useful life value in terms of a ratio of the first signal value to the second signal value.

18. The apparatus of claim 17 comprising a visual indicator that quantifies the remaining useful life value.

19. The apparatus of claim 18 wherein the visual indicator comprises a graphical display.

20. The apparatus of claim 2 comprising a recorder that digitally records the musical sound from the audio input.

* * * * *